United States Patent [19]

Nermes et al.

[11] 3,948,639

[45] Apr. 6, 1976

[54] PROCESS AND DEVICE FOR FLASH SMELTING SULPHIDE ORES AND CONCENTRATES

[75] Inventors: Esko Olavi Nermes; Timo Tapani Talonen, both of Kokkola, Finland

[73] Assignee: Outokumpu Oy, Helsinki, Finland

[22] Filed: Oct. 24, 1973

[21] Appl. No.: 409,100

[30] Foreign Application Priority Data

Oct. 26, 1972 Finland ..... 2978/72

[52] U.S. Cl. ..... 75/9; 75/23; 75/74; 75/26; 266/10; 266/20; 266/24; 423/571

[51] Int. Cl.[2] ..... C22B 1/02

[58] Field of Search ..... 75/23, 73–75, 75/92, 9; 423/148, 567, 571; 266/10, 11, 20, 24

[56] References Cited

UNITED STATES PATENTS

| | | | |
|---|---|---|---|
| 1,338,440 | 4/1920 | Greenwood | 75/23 X |
| 2,772,153 | 11/1956 | West et al. | 423/148 |
| 3,351,462 | 11/1967 | Arentzen et al. | 75/74 |
| 3,554,515 | 1/1971 | Tonooka et al. | 75/74 X |
| 3,790,366 | 2/1974 | Bryk et al. | 75/74 X |

FOREIGN PATENTS OR APPLICATIONS

| | | | |
|---|---|---|---|
| 2,006,945 | 2/1971 | Germany | 75/23 |
| 350,625 | 6/1931 | United Kingdom | 75/23 |

*Primary Examiner*—Allen B. Curtis
*Assistant Examiner*—Thomas A. Waltz
*Attorney, Agent, or Firm*—Brooks, Haidt, Haffner & Delahunty

[57] ABSTRACT

A process and device to be used in the flash smelting of sulphide ores or concentrates is disclosed, wherein the gases emerging from the rising zone of the flash smelting furnace are fed together with the sulphide ore or concentrate into a pretreatment zone, from where the cooled gases are removed for the recovery of sulphur and the pre-treated sulphide ore or concentrate is fed into the upper end of the reaction zone of the flash smelting furnace.

4 Claims, 6 Drawing Figures

Oil of reaction shaft at 100 000 $Nm^3/h$ fluegas from furnace

PROCESS AND DEVICE FOR FLASH SMELTING SULPHIDE ORES AND CONCENTRATES

BACKGROUND OF THE INVENTION

1. Field of the Invention

The invention relates to a process and device for use in flash smelting sulphide ores or concentrates.

2. Description of the Prior Art

In the currently used oxidation-reduction process, pyrite is suspended in hot, oxygenous smoke gases at the upper end of the reaction shaft of a flash smelting furnace. Both a thermal decomposition of the pyrite and a simultaneous partial oxidation of the decomposed sulphur and the iron matte produced in the decomposition process take place in the suspension. The hot, oxygenous smoke gases are obtained by burning oil with a high air coefficient.

The products of the reactions in the reaction shaft are a gas which contains the following compounds, among others: $S_2$, $SO_2$, $H_2S$, COS, $H_2$ and CO, and a melt which consists of FeS, iron oxides and slag. The sulphur content of the gas is produced in the form of elemental sulphur, the melt is granulated and roasted into gaseous sulphur dioxide and iron ore.

The sulphur content in the melt (the rate of iron oxides) is dependent on the oxygen content in the smoke gases fed into the reaction shaft, which again can be regulated by regulating the air coefficient of the oil burning process. By increasing the air coefficient (by decreasing the rate of oil) a larger part of the sulphur present in the concentrate can be released from the concentrate and directed into the gas.

Owing to the more oxidating reaction shaft operation, the rate of sulphur dioxide increases and those of the reducing components ($H_2S$, COS, $H_2$, CO) decrease. The optimal recovery of sulphur prerequires that the gas composition realizes the following equation:

$$SO_2 = \tfrac{1}{2}\,(H_2S + COS + H_2 + CO)$$

For this reason the excess $SO_2$ has been reduced with light petroleum in the rising shaft of the flash smelting furnace.

The sulphur content in the produced iron matte can be lowered by raising the oxygen content in the gas to be fed into the reaction shaft. The ratio between the production of elemental sulphur and that of gaseous sulphur dioxide can thus be regulated by the reaction shaft oil feed — the air rate being constant. The rate of oil used in the reaction shaft burners does not have a significant effect on the smelting capacity of the system (FIG. 2).

The air coefficient of the oil burning also effects the fuel consumption in the process. When the operation takes place at the optimal point in regard to the sulphur yield, all the oxygen fed into the reaction shaft in the combustion air must become bound either to the iron removed along with the iron matte or to the carbon and hydrogen of the fuel and the reduction agent. When the air coefficient rises and the sulphur content of the iron matte lowers, the oxygen content of the matte increases and the sum of the requisite oil and reduction petroleum decreases.

In this known oxidation-reduction process it is not possible to efficiently use in the process the heat of combustion of the concentrate. The heat generated in the roasting of the iron matte is produced in the form of high-pressure steam. The rate of air used in the process is high because air is used both at the smelting and the roasting stages.

A decisive improvement is achieved when a so-called sulphur circulation process is adopted in which the iron matte obtained from the flash smelting furnace is roasted either in its entirety or partially in a roasting furnace, from which all the roasting gases are fed, uncooled, into the flash smelting furnace for the smelting of fresh concentrate.

The following advantages are gained in the process:

The consumption of the reduction agent and/or fuel decreases. This is because the rate of oxygen coming into the flash smelting furnace is lower since part of the oxygen becomes bound to iron in the roasting furnace.

The smelting capacity of the flash smelting furnace is mainly dependent on the content of free oxygen in the gas used and on the temperature of the gas. A rise in the temperature and the oxygen content increases the smelting capacity of the flash smelting furnace.

It is known that the roasting capacity of a roasting furnace can be increased by cooling the fluidized bed by means of cooling devices. The cooling of the bed results in a reduction of excess air in the roasting furnace and a reduction of the content of free oxygen in the roasting gas. The roasting capacity of a roasting furnace at a constant roasting temperature and with a constant air rate can be reduced further, and the oxygen content in the roasting gas can be increased by pre-heating the roasting air.

When in the present process the gas obtained from the roasting furnace is used in the flash smelting furnace for smelting pyrite, the low rate of free oxygen in the gas has a decreasing effect on the flash smelting furnace capacity. A high gas temperature again increases the smelting capacity in comparison to cold air. With the joint effect of these two and by using an uncooled roasting furnace, a smelting capacity which is approximately the same as when using cold air is obtained in the flash smelting furnace.

It is obvious from the above that in this process the capacities of the smelting furnace and the roasting furnace can be controlled by means of cooling devices placed in the fluidized bed in the roasting furnace or by pre-heating the roasting air. Cooling the bed increases the roasting capacity of the roasting furnace and decreases the smelting capacity of the flash smelting furnace. Pre-heating the roasting air produces the opposite effect.

By choosing an appropriate degree of cooling the roasting furnace, the capacities of the roasting furnace and the flash smelting furnace can be balanced so that the rate of melt produced by the flash smelting furnace corresponds to the capacity of the roasting furnace. In this case all the sulphur present in the concentrate is obtained in the form of elemental sulphur. By lowering the degree of cooling of the roasting furnace or by further pre-heating the roasting air, the desired proportion of the iron matte produced in the flash smelting furnace is left for roasting in another roasting furnace to produce gaseous sulphur dioxide (FIGS. 3 and 4).

The capacity of the flash smelting furnace can be raised without significantly affecting the capacity of the roasting furnace, by enriching the roasting air or the roasting gas with oxygen. In this case a higher degree of cooling is required for the roasting furnace in order that the roasting furnace capacity correspond to the iron matte output of the flash smelting furnace. The correspondence is achieved with a greater smelting capacity (FIG. 5).

When copper or nickel concentrate is used as feed in the oxidation-reduction process, the excess oxygen in the reaction shaft must be sufficient, because the slagging of iron at the smelting stage requires a high oxygen pressure in comparison to the pyrite process. When copper concentrate is used in the process according to the invention, the "treatment" of the copper matte from the flash smelting furnace takes place in a previously known manner in a copper converter, the gases of which are then fed as such or concentrated in regard to $SO_2$, possibly mixed with air, into the smelting stage of the flash smelting furnace. With this procedure, the entire sulphur content of the copper concentrate is recovered as elemental sulphur.

Even in the sulphur circulation process the energy is used disadvantageously, because the gas emerges hot from the flash smelting furnace. Especially when the aim is to produce the entire sulphur content of the pyrite as elemental sulphur, the capacity of the process remains low (FIGS. 3 and 4, operation points with no $SO_2$ production).

Raising the capacity by means of oxygen is not the best method, owing to operation and investment costs.

An economic alternative is to use the heat content of the hot gases emerging from the flash smelting furnace for increasing the capacity. However, it is not advantageous to bring energy into the roasting furnace by preheating the combustion air, because it has the effect described above on the ratio between the elemental sulphur and the gaseous $SO_2$ produced from the excess iron matte. Furthermore, the use of the exhaust gases for pre-heating the air is technically difficult because of the molten dust present in the gases.

Both in the sulphur circulation process and the currently used oxidation-reduction process it is possible to pre-heat the concentrate used, e.g., pyrite, but owing to the low heat capacity of the concentrate the obtained benefit is insignificant and this method is not widely used.

SUMMARY OF THE INVENTION

An important advantage is gained if, according to the present invention, the exhaust gases of the flash smelting furnace are used for pre-treating pyrite, because, in addition tp pre-heating, chemical reactions also occur in the material. The pyrite decomposes according to the following formula:

$$FeS_2 + \text{heat} \quad FeS + 1/n \cdot S_n$$

in which $n = 2, 4, 6$, or 8.

The endothermal work achieved in the reaction consumes an amount of heat energy 2–4 times the heat capacity of the pyrite. Since the endothermal work connected with the sublimation of pyrite is a significant consumer of energy in the reaction shaft of the flash smelting furnace, the work achieved in the pre-treatment of pyrite is an advantage in the flash smelting furnace.

If the raw material of the process is copper or nickel concentrate, the pyrite present in the concentrate decomposes in the manner described above. In addition, the copper compounds decompose in the following manner:

$$(CuFe)S_2 \quad CuS + FeS$$

$$2\,CuS \quad Cu_2S + 1/n\ S_n$$

The removal of sulphur without oxidation from the concentrate is advantageous for the flash smelting of copper concentrates. It is also possible not to reduce the gases until after the pre-treatment of concentrate described above.

The gases cooled in the pre-treatment of pyrite are further fed into the cooling, purification, catalysis, and sulphur recovery. Before the pyrite is fed into the decomposition shaft, the gases are reduced with a reducing agent in the rising shaft of the flash smelting furnace so that the component contents in the gas realize the following equation:

$$SO_2 = \tfrac{1}{2}\,(H_2S + COS + CO + H_2)$$

The process comprises four successive stages, countercurrent in regard to the concentrate and the gas:

1. The iron matte obtained from the flash smelting furnace is roasted into iron oxide in the roasting furnace, at which time part of the oxygen of the air becomes bound to iron. The roasting furnace is controlled by pre-heating the combustion air or by cooling the fluidized bed so that the oxygen content in the roasting gas is sufficient for maintaining the capacity of the flash smelting furnace. The rate of iron matte which becomes roasted in the roasting furnace linked to the flash smelting furnace is determined simultaneously.

2. At the second stage, the hot roasting gas emerging from the roasting furnace and the pre-treated pyrite emerging from the pyrite decompositon shaft are fed into the flash smelting furnace.

At this stage, part of the oxygen of the roasting gas becomes bound to the iron and is removed along with the iron matte, thereby lessening the consumption of fuel and reduction agent in the process, while part of it becomes bound to the sulphur of the reaction shaft feed, thereby forming sulphur dioxide. The sulphur of the reaction shaft feed is divided between the iron matte and the gas, the sulphur in the gas being partly in the form of sulphur dioxide, partly in the form of elemental sulphur.

The temperature in the flash smelting furnace is about 1200°C. For this reason the iron matte emerges from the furnace in a molten state. The molten iron matte can be granulated so that the granule size is well applicable to fluidizedbed roasting and the product of the roasting is applicable as iron ore.

3. For optimal sulphur yield, the composition of the gas must realize the equation $SO_2 = \tfrac{1}{2}\,(H_2S + COS + H_2 + CO)$. To achieve this, the gas must be reduced with some reduction agent before the catalysis. The best place for performing the reduction is the rising shaft of the flash smelting furnace, where the temperature is about 1200°C.

4. The heat present in the hot gases from the flash smelting furnace can be put to use by treating the feed of the pyrite furnace with them. Part of the heat content of the gases becomes bound to the pyrite as its heat content. A significantly larger part of the heat, however, is used for endothermal decomposition of the pyrite. All of this endothermal work is an advantage because it no longer needs to occur in the reaction shaft of the flash smelting furnace when the pyrite is fed into it.

DESCRIPTION OF THE PREFERRED EMBODIMENTS

Figure 6:
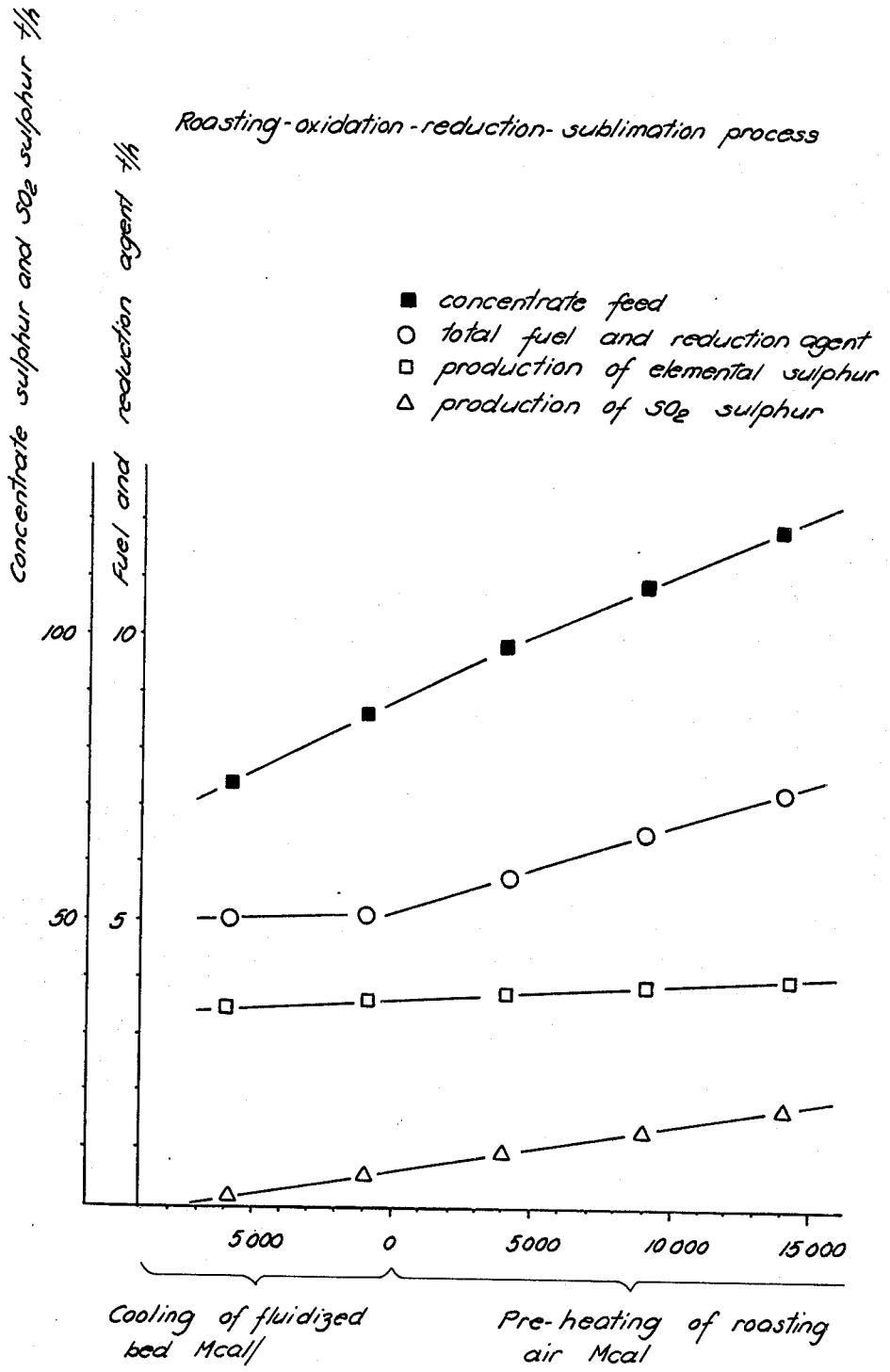

A significantly higher capacity is achieved by the process according to the invention than by the sulphur circulation process, and the rate of waste produced as steam is decreased. The size of the boiler is also decisively reduced. The capacity can be kept approximately the same as in the oxidation-reduction process, even when the roasting furnace linked to the flash smelting furnace is operated so that the entire sulphur content of the concentrate is produced as elemental sulphur (FIG. 6). The consumptions of fuel and reduction agent in this process are less than in any other process described above. This is due to the advantageous heat economy of the process. A great part, and in an extreme case all, of the iron carried along with the concentrate is used as fuel in the process. This decreases the rate of reduction agent to be used for binding the oxygen.

It is also possible to link the decomposition shaft described above to the oxidation-reduction process and to eliminate the roasting furnace contained in the sulphur circulation process. In this case the capacity of the process rises significantly.

Figure 1:
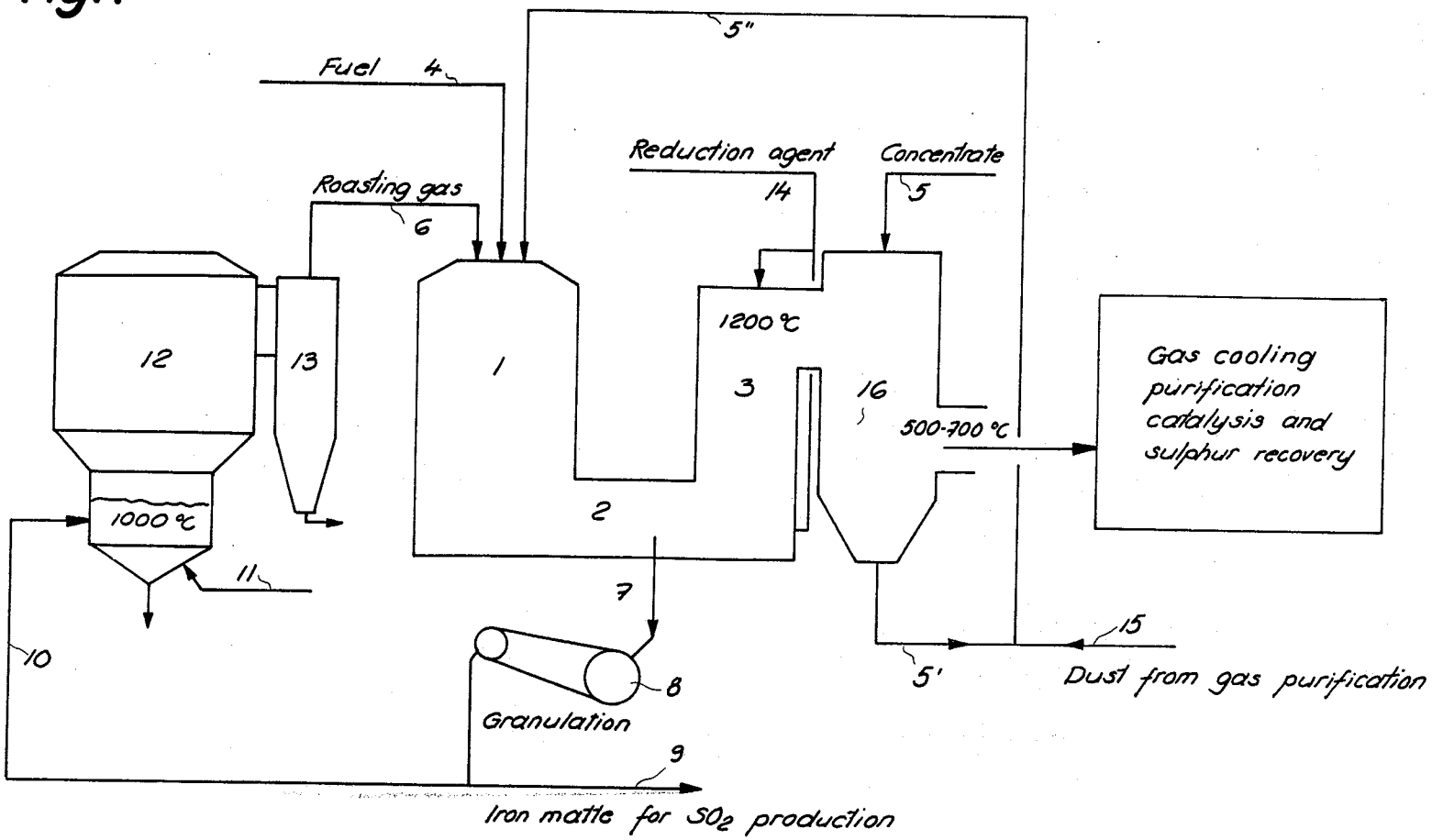
FIG. 1 shows a schematic side view of a preferred embodiment of the invention and FIGS. 2–6 show, among other things, the concentrate, sulphur, fuel, and reduction agent as functions of the cooling of the fluidized bed and the preheating of the roasting air.
Figure 2:
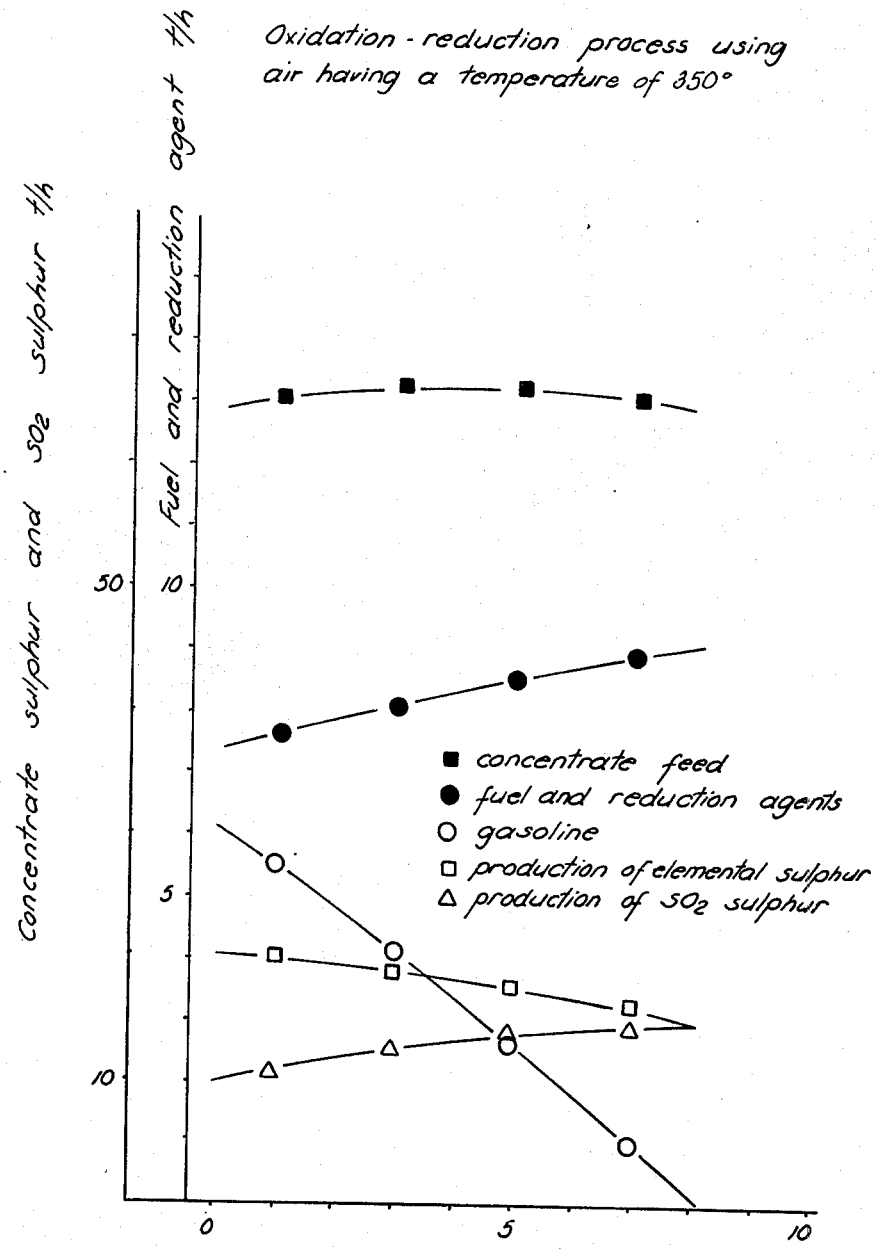
Figure 3:
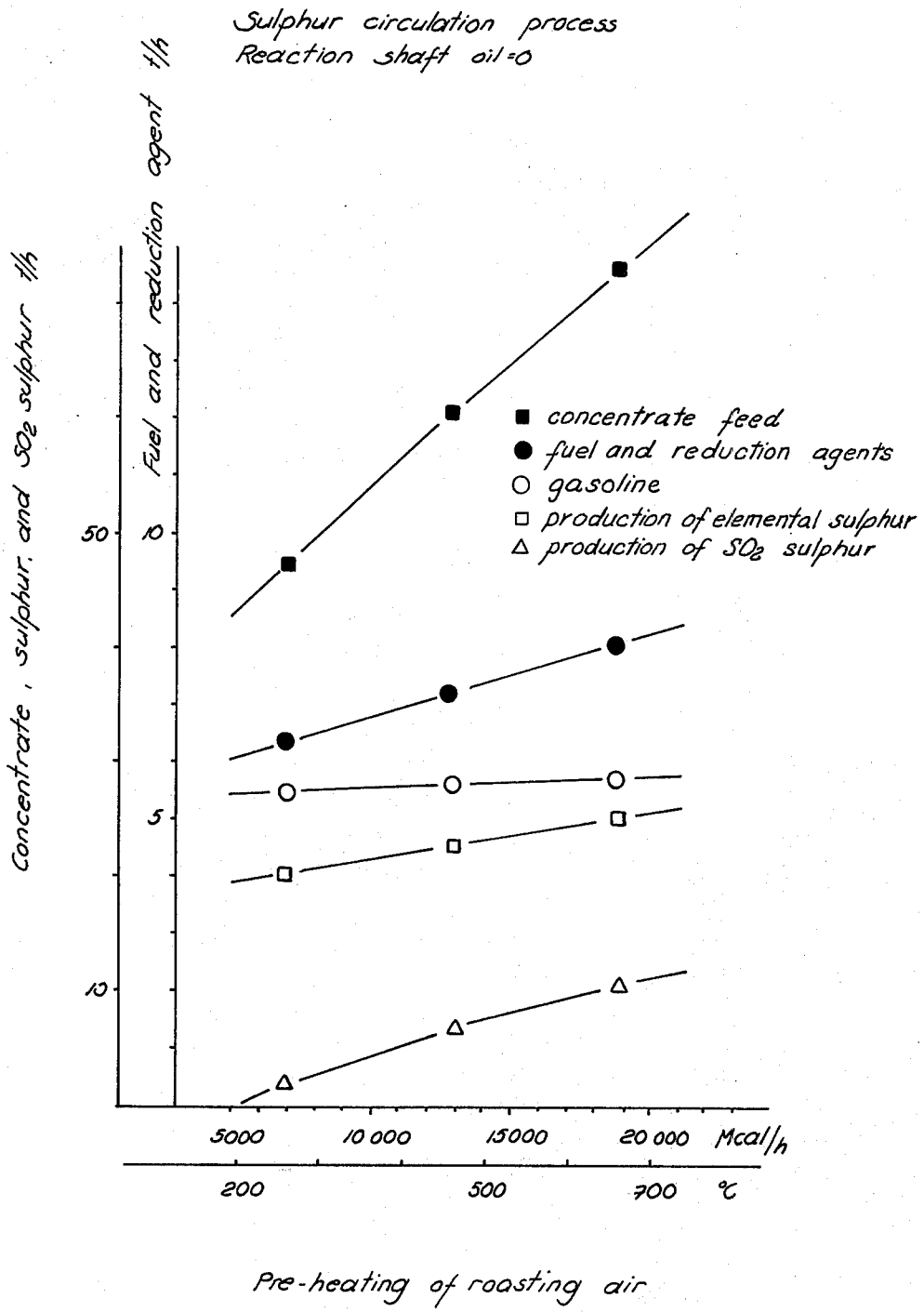
Figure 4:
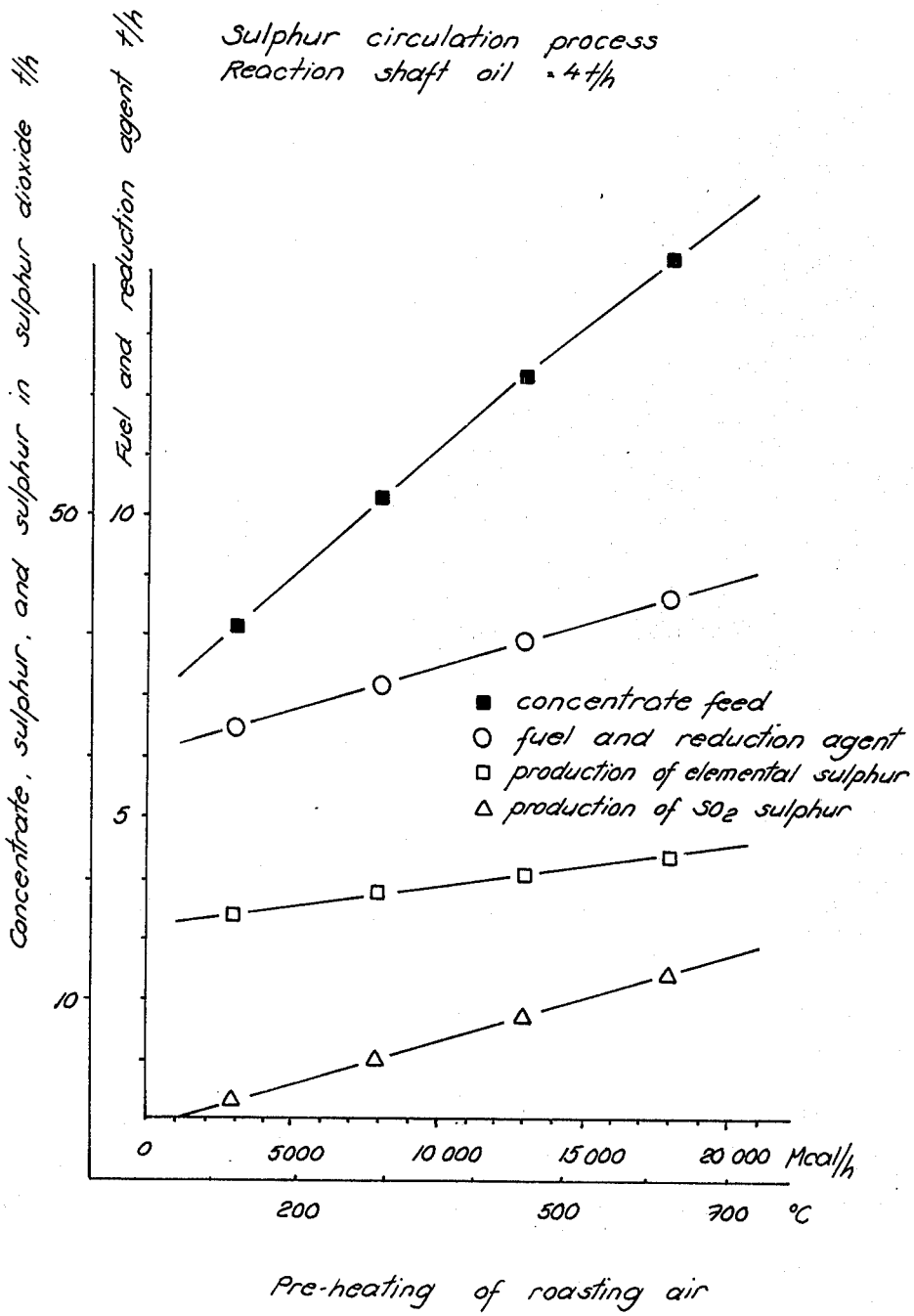
Figure 5:
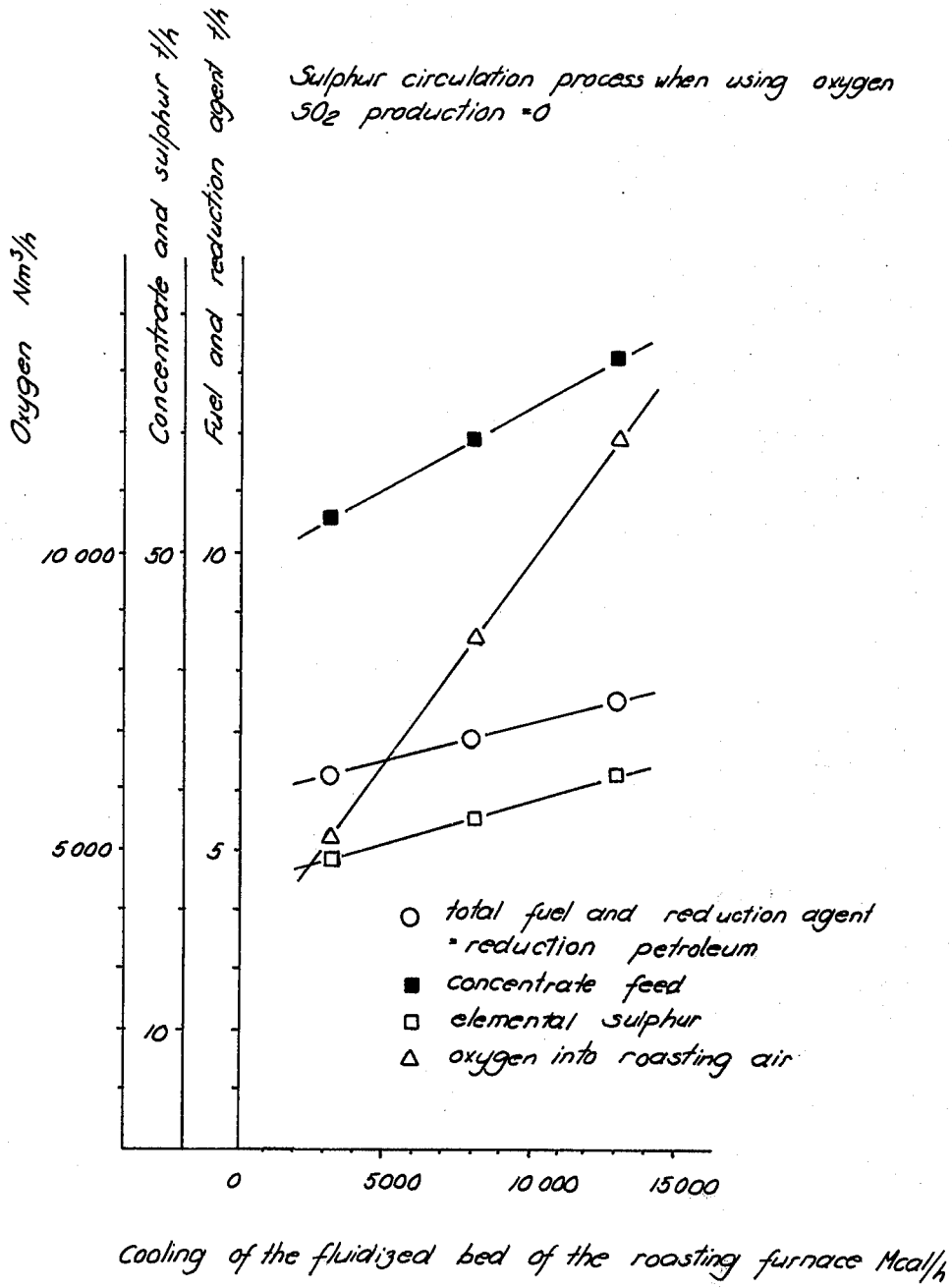

The flash smelting furnace shown in FIG. 1 mainly comprises three parts, i.e., a vertical reaction shaft 1 and a rising shaft 3, the lower ends of which have been connected to the two ends of a horizontal lower furnace 2. The fuel and the concentrate are fed through pipes 4 and 5 into the upper part of the reaction shaft 1, and the reduction agent is fed through pipe 14 into the upper and lower parts of the rising shaft 3. Molten iron matte is recovered from the lower furnace 2 through pipe 7 into a granulation device 8. Part of the granulated iron matte is fed through feeding line 9 into the $SO_2$ production and part of it through feeding line 10 into a fluidized-bed furnace 12 which works as a roasting furnace and where the capacity is controlled by a cooling device (not shown). The temperature is about 1000°C. Air is also fed into the fluidized-bed furnace through feeding pipe 11, and the hot roasting gases are fed from the upper part of the fluidized-bed furnace through a cyclone 13 and connecting pipe 6 into the upper part of the reaction shaft 1 of the flash smelting furnace.

The gases emerging from the upper part of the rising shaft 3, at the temperature of about 1200°C, are fed into a pre-treatment shaft 16 linked after the rising shaft 3 or into a cyclone-type reactor, into which concentrate is also fed from above through feeding pipe 5. The cooled gases are removed from the pre-treatment shaft at about 500°–700°C and are finally fed into an additional cooling, purification, catalysis, and sulphur recovery. The dust emerging from the gas purification is directed through pipe 15 into the pretreatment concentrate exhaust pipe 5' and is fed through pipe 5'', together with the pre-treatment concentrate into the upper part of the reaction shaft 1 as a sulphur concentrate with a temperature of about 500°–800°C.

The oxygen content of the roasting gas fed into the upper part of the reaction shaft 1 is preferably about 5–8 % and its $SO_2$ content about 1–10 %.

The research concerning the process was made both by mathematical calculations and by performing experimental operations on a pilot scale. The basis of the investigations was a mathematical model basically based on physical chemistry. The parts of the model illustrating the various stages of the process were adjusted to the results of the experimental operations which were obtained partly on a pilot scale and partly on a full industrial scale. The results obtained from the model agree well with the results of the experiments. Various operational points of the process can be simulated with the mathematical model of the process. The examples have been calculated assuming that:

- the sulphur content of the iron pyrite concentrate is 49.6 % and its iron content 46.3 %
- the highest possible gas load after the flash smelting furnace is 100 000 $Nm^3/h$
- the heat losses of the roasting furnace and the gas pipe system are 1000 Mcal/h
- the heat losses of the reaction shaft of the flash smelting furnace are 8000 Mcal/h
- the heat losses of the reduction shaft are 400 Mcal/h
- the heat losses of the decomposition shaft are 500 Mcal/h
- the air humidity is 4 $g/Nm^3$.

EXAMPLE 1

The total sulphur content of the pyrite is produced as elemental sulphur.

In this case the fluidized bed of the roasting furnace is cooled so that the capacity of the roasting furnace corresponds to the rate of iron production of the flash smelting furnace. The operation point of the process is then as follows:

| | | |
|---|---|---|
| roasting air temperature | | 25°C |
| cooling of fluidized bed | | 9500 Mcal/h |
| rate of roasting air | | 110 000 $Nm^3/h$ |
| rate of roasting gas | | 102 000 $Nm^3/h$ |
| $SO_2$ in roasting gas | | 8 % |
| $O_2$ in roasting gas | | 7.5 % |
| concentrate into decomposition shaft | | 67.5 t/h |
| solid material from decomposition shaft | | 51.0 t/h |
| | S | 33.1% |
| | Fe | 61.4 % |
| capacity of flash smelting furnace | | 51.0 t/h |
| iron matte produced | | 45.0 t/h |
| capacity of roasting furnace | | 45.0 t/h |
| production of elemental sulphur | | 30.5 t/h - losses |
| production of $SO_2$ sulphur | | 0 |
| temperature after reaction shaft | | 1250°C |
| temperature after reduction shaft | | 1200°C |
| temperature after decomposition shaft | | 615°C |
| roasting furnace temperature | | 1000°C |
| roasting gas temperature | | 980°C |

EXAMPLE 2

Roasting is carried out with air at about 50°C without cooling the fluidized bed of the roasting furnace.

| | | |
|---|---|---|
| roasting air temperature | | 50°C |
| cooling of fluidized bed | | 0 Mcal/h |
| rate of roasting air | | 105 000 $Nm^3/h$ |
| rate of roasting gas | | 101 000 $Nm^3/h$ |
| $SO_2$ in roasting gas | | 6.1 % |
| $O_2$ in roasting gas | | 10.7 % |
| concentrate into decomposition shaft | | 90.9 t/h |
| solid material from decomposition shaft | | 74.7 t/h |
| | S | 38.8 % |
| | Fe | 56.3 % |

-continued

| | |
|---|---|
| capacity of flash smelting furnace | 74.7 t/h |
| iron matte produced | 60.5 t/h |
| capacity of roasting furnace | 31.8 t/h |
| production of elemental sulphur | 34.3 t/h-losses |
| production of $SO_2$ sulphur | 8.0 t/h |
| temperature after reaction shaft | 1250°C |
| temperature after reduction shaft | 1200°C |
| temperature after decomposition reactor | 580°C |
| temperature of roasting furnace | 1000°C |
| temperature of roasting gas | 980°C |

EXAMPLE 3

Roasting is carried out with air at 500°C without cooling the fluidized bed.

| | | |
|---|---|---|
| temperature of roasting air | | 500°C |
| cooling of fluidized bed | | 0 Mcal/h |
| rate of roasting air | | 100 000 $Nm^3/h$ |
| rate of roasting gas | | 98 000 $Nm^3/h$ |
| $SO_2$ in roasting gas | | 3.3 % |
| $O_2$ in roasting gas | | 15.2 % |
| concentrate into decomposition shaft | | 117 t/h |
| solid material from decomposition shaft | | 103 t/h |
| | S | 42.7 % |
| | Fe | 52.7 % |
| capacity of flash smelting furnace | | 117 t/h |
| solid material from decomposition shaft | | 103 t/h |
| | S | 42.7 % |
| | Fe | 52.7 % |
| capacity of flash smelting furnace | | 117 t/h |
| iron matte produced | | 74.8 t/h |
| capacity of roasting furnace | | 16.6 t/h |
| production of elemental sulphur | | 37.0 t/h |
| production of $SO_2$ sulphur | | 16.4 t/h |
| temperature after reaction shaft | | 1250°C |
| temperature after reduction shaft | | 1200°C |
| temperature after decomposition reactor | | 580°C |
| temperature of roasting furnace | | 1000°C |
| temperature of roasting gas | | 980°C |

What is claimed is:

1. In a process for flash smelting a raw material selected from sulphide ores and concentrates in a flash smelting furnace having a lower horizontal furnace for the smelt, a vertical reaction zone connected at its bottom and communicating with one end of the lower furnace, means for feeding fuel to the reaction zone, a vertical rising zone connected at its bottom and communicating with the other end of the lower furnace, the steps of:

a. feeding flue gases from the rising zone directly to a pre-treatment zone at about 1000°–1400°C into contact with raw material fed to the pre-treatment zone for endothermal decomposition of raw material while simultaneously, b. cooling the flue gases emerging from the rising zone at about 1000°–1400°C in the pre-treatment to about 450° – 900°C, c. withdrawing the cooled gases from the pretreatment zone and recovering sulphur from the same, and d. withdrawing and conducting decomposed and pre-treated raw material from the pre-treatment zone to the vertical reaction shaft of the flash smelting furnace.

2. The process of Claim 1, in which the raw material is heated by the flue gases in the pre-treatment zone to about 400° – 800°C in order to decompose and preheat the sulphidic raw material.

3. The process of claim 1, in which decomposed and pre-heated sulphidic raw material is fed into the reaction zone together with dust separated from the cooled gases.

4. In a flash smelting furnace having a lower horizontal furnace for the smelt; a vertical reaction shaft connected at its bottom and communicating with one end of the lower furnace; means for feeding fuel and oxidation gas; and a vertical rising shaft connected at its bottom and communicating with the opposite end of the lower furnace:

a. a pre-treatment shaft;

b. means for withdrawing and feeding flue gases from the rising shaft directly to the pre-treatment shaft;

c. means for feeding raw material to the upper part of the pre-treatment shaft to achieve direct heat exchange between the sulphidic raw material and the hot flue gases;

d. means for withdrawing from the lower part of the pre-treatment zone decomposed and pre-heated raw material and feeding the same to the upper part of the reaction shaft of the flash smelting furnace; and e. means for withdrawing the cooled gases from the pre-treatment shaft and recovering sulphur from it.

* * * * *

UNITED STATES PATENT OFFICE

CERTIFICATE OF CORRECTION

PATENT NO. : 3,948,639

DATED : April 6, 1976

INVENTOR(S) : Esko Olavi Nermes et al

It is certified that error appears in the above-identified patent and that said Letters Patent are hereby corrected as shown below:

Col. 3, line 48 "tp" should be --to--

Col. 3, line 51 no arrow in formula

Col. 4, line 1 no arrow in formula

Col. 4, line 3 no arrow in formula

Signed and Sealed this

Nineteenth Day of April 1977

[SEAL]

*Attest:*

RUTH C. MASON
*Attesting Officer*

C. MARSHALL DANN
*Commissioner of Patents and Trademarks*